US006389259B2

(12) United States Patent
Kim

(10) Patent No.: US 6,389,259 B2
(45) Date of Patent: May 14, 2002

(54) LIQUID ELECTROPHOTOGRAPHIC PRINTING APPARATUS HAVING STRUCTURE SO THAT DIFFERENCES IN PEELING FORCES CAN BE CONTROLLED

(75) Inventor: Jong-woo Kim, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/793,959

(22) Filed: Feb. 28, 2001

(30) Foreign Application Priority Data

May 15, 2000 (KR) ..... 00-25768

(51) Int. Cl.[7] ..... G03G 15/16

(52) U.S. Cl. ..... 399/297; 399/302; 399/307; 399/308

(58) Field of Search ..... 399/101, 297, 399/302, 307, 308, 326, 327

(56) References Cited

U.S. PATENT DOCUMENTS 6,026,271 A * 2/2000 Saitoh ..... 399/308

6,201,940 B1 * 3/2001 Lee ..... 399/101

* cited by examiner

*Primary Examiner*—William J. Royer

(74) *Attorney, Agent, or Firm*—Sughrue Mion, PLLC

(57) ABSTRACT

A liquid electrophotographic printing apparatus includes a photosensitive belt circulating around a predetermined track. A transfer roller contacts the photosensitive belt, and receives an image therefrom. A fuser roller presses against the transfer roller so that the toner image transferred to the transfer roller is transferred to a sheet of paper passing between the transfer roller and the fuser roller. A fuser roller cleaning device selectively contacts the fuser roller and maintains a peeling force of the fuser roller within a predetermined range. A peeling force adjusting device selectively contacts the transfer roller and maintains a peeling force of the transfer roller within a predetermined range. The surface energies $SE_T$, $SE_P$, and $SE_F$ of the transfer roller, the paper sheet, and the fuser roller, respectively, satisfy the following inequality: $SE_T<SE_P<SE_F$.

9 Claims, 4 Drawing Sheets

LIQUID ELECTROPHOTOGRAPHIC PRINTING APPARATUS HAVING STRUCTURE SO THAT DIFFERENCES IN PEELING FORCES CAN BE CONTROLLED

RELATED APPLICATIONS

This application claims priority to an application entitled "Liquid Electrophotographic Printing Apparatus" filed in the Republic of Korea on May 15, 2000, and assigned Application No. 00-25768, the contents of which are hereby incorporated by reference.

BACKGROUND OF THE INVENTION

1. Field of the Invention

The present invention relates to a liquid electrophotographic printing apparatus, and more particularly, to a liquid electrophotographic printing apparatus having an improved structure so that differences in peeling forces of a photosensitive belt, a transfer roller, and a fuser roller which occur during image transfer, can be controlled to be within a predetermined range.

2. Description of the Related Art

In general, in a liquid electrophotographic printing apparatus, a laser beam scans a photosensitive medium to form an electrostatic latent image on the photosensitive medium, a liquid developer having a predetermined color is applied to the electrostatic latent image area of the photosensitive medium to develop the electrostatic latent image, and then the developed image is printed on a sheet of paper when the image is transferred to the paper via a transfer unit.

Referring to FIG. 1, in a conventional liquid electrophotographic printing apparatus, electrostatic latent images formed on a photosensitive belt 10 by laser scanning units are developed at developing units 20, sequentially and respectively, and then carrier included in the developed image is dried by a drying unit 30, and the image is transferred to a paper sheet (P) via a transfer unit 40.

The transfer unit 40 comprises a transfer roller 41 which is installed to face a transfer backup roller 12 and to which the image (I) developed on the photosensitive belt 10 is transferred, and a fuser roller 43 disposed to face the transfer roller 41. Here, the image transfer from the photosensitive belt 10 to the transfer roller 41 is referred to as transfer $T_1$, and the image transfer from the transfer roller 41 to the paper sheet (P) is referred to as transfer $T_2$.

In the liquid electrophotographic printing apparatus configured as described above, whether or not the developed image is transferred from one device to another is determined by differences in surface energies of the photosensitive belt 10, the transfer roller 41, the paper sheet (P), and the fuser roller 43. The surface energy varies with not only materials of components but also heat and pressure developed during the transfer operation. That is, since the toner constituting an image is transferred from a component having a smaller surface energy to another having a larger surface energy, the materials of individual components and pressing forces between the components are decided by considering those factors. Here, the surface energy acts as a factor deciding the surface adhering force of the toner particle, and the surface energies of the components are relatively decided by measuring the peeling forces (g/inch) of the respective components which can be measured. Peeling force is the force required to peel off a measuring tape attached to a component such as the photosensitive belt 10, the transfer roller 41, the fuser roller 43, and the like, and is a relative value which depends on the type of adhesive tape for measuring a peeling force, the pressing force applied when the adhesive tape is attached to an objective component, the speed of a peeling force measuring apparatus, the ambient temperature of the measuring apparatus, and the like.

Since the peeling force measuring apparatus is described in U.S. application Ser No. 09/666,805 entitled "Electrophotographic Printing Apparatus and Image Transferring Method for an Electrophotographic Printing Apparatus", filed by the applicant of this application, a detailed description thereof will be omitted. The contents of U.S. application Ser. No. 09/666,805 are hereby incorporated by reference.

When the peeling forces required at the photosensitive belt 10, the transfer roller 41, and the fixing roller 43 were measured with the same conditions by the above measuring method according to the number of printed paper sheets, it was found that the peeling force increased as the number of printed sheets of paper increased in a general liquid electrophotographic printing apparatus, as shown by the graph in FIG. 2.

Here, the peeling force required at the sheet of paper varies depending on the manufacturer and the use of the printed sheet of paper, and has a constant value in the range of about 600 to 800 g/inch.

Referring to FIGS. 1 and 2, in the transfer $T_1$, since the difference in the peeling forces of the photosensitive belt 10 and the transfer roller 41 is not large at an initial stage (area S1 of FIG. 2), the toner image (I) developed on the photosensitive belt 10 is not completely transferred to the transfer roller 41. The peeling force of the photosensitive belt 10 is increased by the toner of the remaining toner image on the photosensitive belt 10. Accordingly, the efficiency of image transfer from the photosensitive belt 10 to the transfer roller decreases.

Also, in the transfer $T_2$, as the difference in the peeling forces of the transfer roller 41 and the sheet of paper (P) decreases gradually in area S2 as the number of printed sheets increases, the toner image is not completely transferred from the transfer roller 41 to the sheet of paper (P), and remains on the transfer roller 41. Accordingly, as the toner continues to accumulate on the transfer roller 41, the peeling force of the transfer roller 41 increases. In addition, since the fuser roller 43 continues to have a peeling force smaller than that of the transfer roller 41, the toner accumulated on the transfer roller 41 cannot easily move to the fuser roller 43, and the toner continues to accumulate on the transfer roller 41 resulting in poor transfer.

In addition, the peeling force of the transfer roller 41 increases beyond 500 g/inch when the number of printed sheets is greater than 2000 in area S3, and therefore the difference in the peeling forces of the sheet of paper (P) and the transfer roller 41 begins to decrease. In addition, since the peeling force of the employed toner itself is about 600 g/inch, there is a problem in that the sheet of paper (P) wraps around the transfer roller 41, and cannot be discharged to the outside to result in a paper jam in the printer.

SUMMARY OF THE INVENTION

To solve the above problems, it is an objective of the present invention to provide an electrophotographic printing apparatus adapted to set up the relationships of the peeling forces required at a photosensitive belt, a transfer roller, and a fuser roller, and to adjust the peeling force of the transfer roller to decrease the possibility of a bad image transfer.

Accordingly, to achieve the above objective, there is provided a liquid electrophotographic printing apparatus including: a photosensitive belt circulating around a predetermined track; a transfer roller to which an image developed by developing units on the photosensitive belt is transferred while the transfer roller contacts and is rotated by the photosensitive belt; a fuser roller providing a pressing force for the transfer roller so that the toner image transferred to the transfer roller can be transferred to a sheet of paper passing through between the transfer roller and the fuser roller; a fuser roller cleaning device contacting the fuser roller continuously or intermittently and maintaining the peeling force of the fuser roller so that the value of the peeling force of the fuser roller can be controlled to within a predetermined range; and a peeling force adjusting device for maintaining the peeling force of the transfer roller so that the value of the peeling force of the transfer roller can be controlled to within a predetermined range, wherein the surface energies $SE_T$, $SE_P$, and $SE_F$ of the transfer roller, the paper sheet, and the fuser roller, respectively, satisfy the following inequality $$SE_T<SE_P<SE_F.$$

BRIEF DESCRIPTION OF THE DRAWINGS

The above objective and advantages of the present invention will become more apparent by describing in detail preferred embodiments thereof with reference to the attached drawings in which.

DESCRIPTION OF THE PREFERRED EMBODIMENTS

Figure 1:
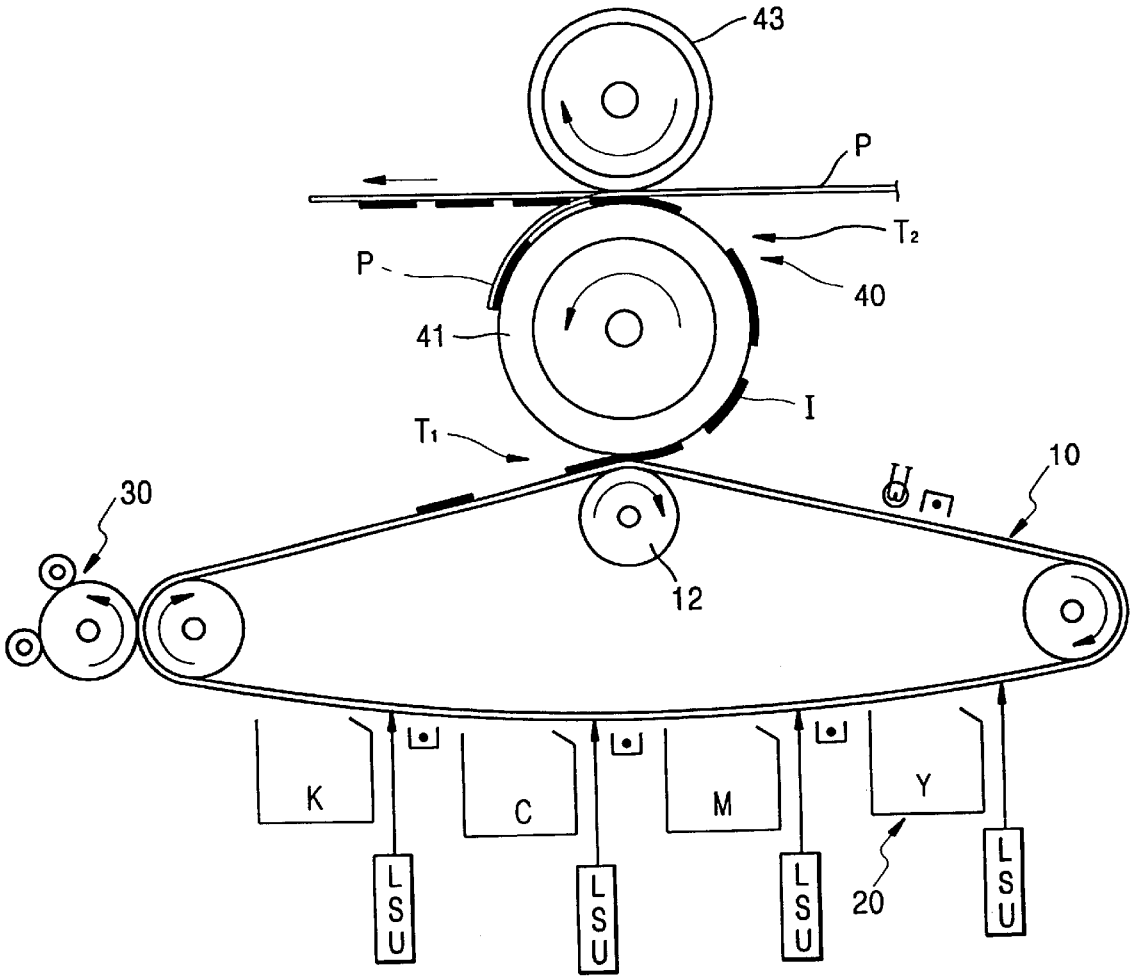
FIG. 1 (PRIOR ART)
FIG. 1 is a schematic diagram illustrating a conventional electrophotographic printing apparatus.
Figure 2:
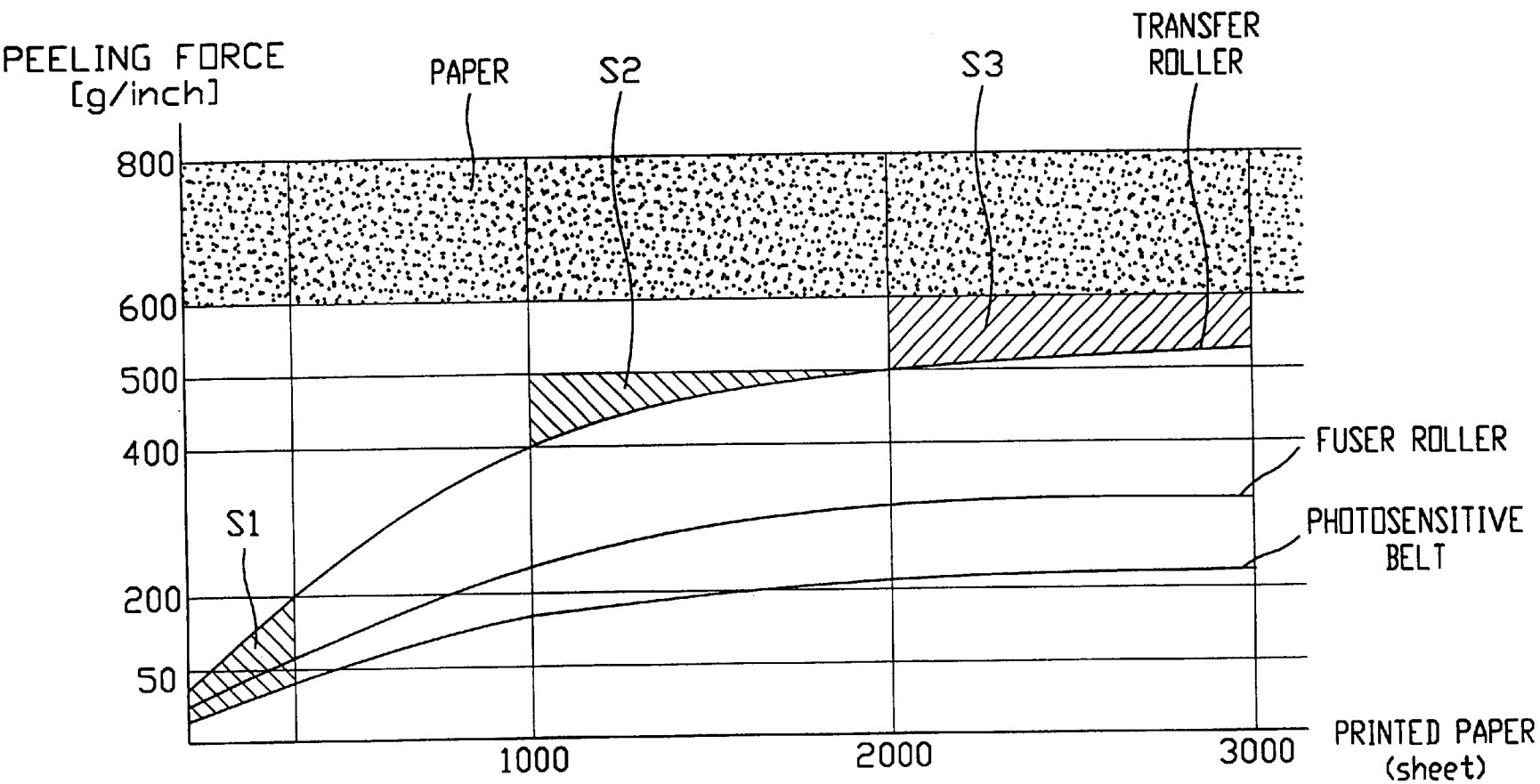
FIG. 2 (PRIOR ART)
FIG. 2 is a graph illustrating the relationships of the peeling forces of a photosensitive belt, a transfer roller, and a fuser roller of the printing apparatus shown in FIG. 1 according to the number of printed sheets of paper.
Figure 3:
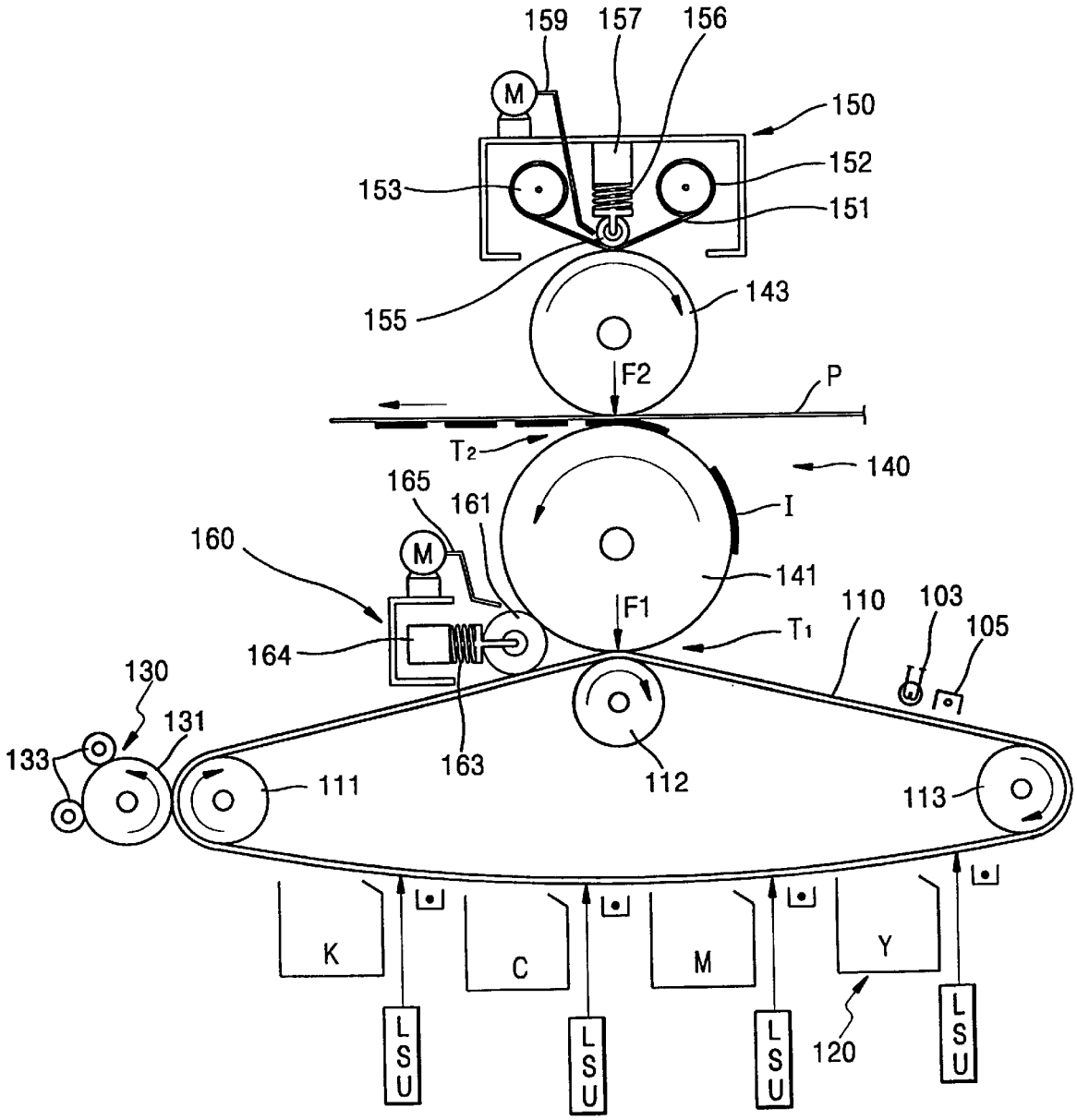
FIG. 3 is a diagram illustrating an electrophotographic printing apparatus according to an embodiment of the present invention.

Referring to FIG. 3, a liquid electrophotographic printing apparatus according to a preferred embodiment of the present invention comprises a photosensitive belt 110 circulating around a predetermined track, laser scanning units (LSU) for sequentially scanning the photosensitive belt 110 with respective beams to form respective electrostatic images, developing units 120 for sequentially developing the respective electrostatic latent images on the photosensitive belt 110, a drying unit 130 for drying the carrier remaining in the toner image formed on the photosensitive belt 110, a transfer unit 140 for transferring the image (I) transported by the photosensitive belt 110 to a sheet of paper (P), a fuser roller cleaning device 150, and a peeling force adjusting device 160.

The photosensitive belt 110 circulates around a driving roller 111, a transfer backup roller 112, and a steering roller 113. In the vicinity of the photosensitive belt 110, a discharging device 103 for lowering the potential formed on the photosensitive belt 110 to a constant level by illuminating the photosensitive belt 110, and a charging device 105 for charging the photosensitive belt 110 discharged by the discharging device 103 to a predetermined potential level, are installed.

In addition, the drying unit 130 comprises a drying roller 131 which contacts the surface of the photosensitive belt 110 on which an image is formed for absorbing the remaining carrier, and regeneration rollers 133 for heating the surface of the drying roller 131 and evaporating the absorbed carrier thereof.

The transfer unit 140 comprises a transfer roller 141 and a fuser roller 143. The transfer roller 141 is disposed to face the transfer backup roller 112 with the photosensitive belt 110 disposed therebetween so that the image (I) developed on the photosensitive belt 110 can be transferred thereto. The fuser roller 143 is disposed to face the transfer roller 141 with the sheet of paper (P) passing therebetween for fusing the image on the sheet of paper (P) so that the image can be transferred to the paper sheet (P).

Here, the surface energies $SE_T$, $SE_P$, and $SE_F$ of the transfer roller 141, the paper sheet (P), and the fuser roller 143, respectively, satisfy the inequality in Equation (1) below.

$$SE_T<SE_P<SE_F \quad (1)$$

Preferably, the peeling forces $PF_O$, $PF_T$, and $PF_F$ of the photosensitive belt 110, the transfer roller 141, and the fuser roller 143, respectively, satisfy the inequalities in Equation (2) below, even when the number of printed sheets of paper increases.

$$5 \leqq PF_O \leqq 200 \text{ (g/inch)}$$

$$200 \leqq PF_T \leqq 500 \text{ (g/inch)}$$

$$900 \leqq PF_F \leqq 1200 \text{ (g/inch)} \quad (2)$$

Here, the peeling force $PF_P$ of the sheet of paper (P) is a fixed value in the range of 600~800 g/inch depending on the material of the sheet of paper (P).

It is preferable that the fuser roller 143 is made of a metal such as aluminum (Al) and aluminum alloys whose peeling force is greater than that of the transfer roller 141 so that the inequality of Equation (1) can be satisfied. As a result of measurement, in general, the peeling force of aluminum is about 900 g/inch. In an embodiment of the present invention, aluminum heat-treated to have a peeling force of 1200 g/inch is employed. Therefore, since the toner and other foreign materials remaining on the transfer roller 141 are easily moved to the fuser roller 143, and the fuser roller 143 serves to clean the transfer roller 141, an increase in the peeling force of the transfer roller 141 is prevented.

In addition, since the peeling force of the toner itself is about 600 g/inch, and is lower than that of aluminum, when the toner and other foreign materials continue to accumulate on the fuser roller 143, the peeling force of the fuser roller 143 decreases gradually due to the accumulated toner. As described above, when the peeling force of the fuser roller 143 is lowered, the back surface of the paper sheet (P) may become contaminated, or a picking event in which an image is partially picked off may occur when both sides of the paper sheet are printed.

The fuser roller cleaning device 150 is intended to restrain the peeling force of the fuser roller from being lowered as described above. The fuser roller cleaning device 150 comprises a cleaning belt 151 contacting the fuser roller 143, a supply reel 152 around which the cleaning belt 151 is wound, a take-up reel 153 for winding the cleaning belt 151, and a pressing device for causing the cleaning belt 151 to selectively contact the fuser roller 143.

The pressing device is intended to cause the cleaning belt 151 which is normally spaced from the fuser roller 143 to contact the fuser roller 143 after a predetermined number of sheets of paper have been printed. The pressing device includes a pressing member 155 disposed to face the fuser roller 143 with the cleaning belt 151 disposed therebetween, an elastic member 156 for elastically biasing the pressing member 155 so that the pressing member 155 can cause the cleaning belt 151 to contact the fuser roller 143, and a cylinder 157 for separating the pressing member 155 from the cleaning belt 151. In addition, it is preferable that a carrier supplying device 159 is installed at the fuser roller cleaning device 150 for supplying a liquid carrier to the contacting portion between the cleaning belt 151 and the fuser roller 143 when the cleaning belt 151 contacts the fuser roller 143.

The peeling force adjusting device 160 adjusts the peeling forces so that the peeling force of the transfer roller 141 can be greater than that of the photosensitive belt 110, and can be smaller than that of the sheet of paper (P) in a printing mode. The peeling force adjusting device 160 comprises a friction member 161 for removing foreign materials remaining on the photosensitive belt 110 and the transfer roller 141, and a pressing device for causing the friction member 161 to intermittently contact or be separated from the photosensitive belt 110 and the transfer roller 141. The friction member 161 contacts the photosensitive belt 110 and the transfer roller 141 simultaneously.

In addition, it is preferable that the peeling force adjusting device 160 further includes a carrier supply nozzle 165 so that when the friction member 161 contacts the photosensitive belt 110 and the transfer roller 141, the liquid carrier can be supplied to the friction member 161. The pressing member includes a spring member 163 for pressing the friction member 161 toward the photosensitive belt 110 and the transfer roller 141, and a cylinder 164 for separating the spring member 163 from the photosensitive belt 110 and the transfer roller 141. The friction member 161 intermittently contacts the photosensitive belt 110 and the transfer roller 141, and removes foreign materials such as toner remaining on the photosensitive belt 110 and the transfer roller 141. Therefore, this restrains the peeling forces of the photosensitive belt 110 and the transfer roller 141 from increasing.

Now, the operation of the liquid electrophotographic printing apparatus configured as described according to an embodiment of the present invention will be described in detail with reference to FIGS. 3 and 4.

At the initial stage of printing, the carrier is supplied to the friction member 161 while the friction member 161 is caused to contact the surfaces of the photosensitive belt 110 and the transfer roller 141. When the carrier is supplied to the photosensitive belt 110 and the transfer roller 141, the peeling force of the transfer roller 141 increases faster than that of the photosensitive belt 110, as shown in hatched area S5 of FIG. 4, and the difference in the peeling forces of the photosensitive belt 110 and the transfer roller 141 becomes larger. Therefore, the efficiency of image transfer from the photosensitive belt 110 to the transfer roller 141 can be enhanced.

Figure 4:
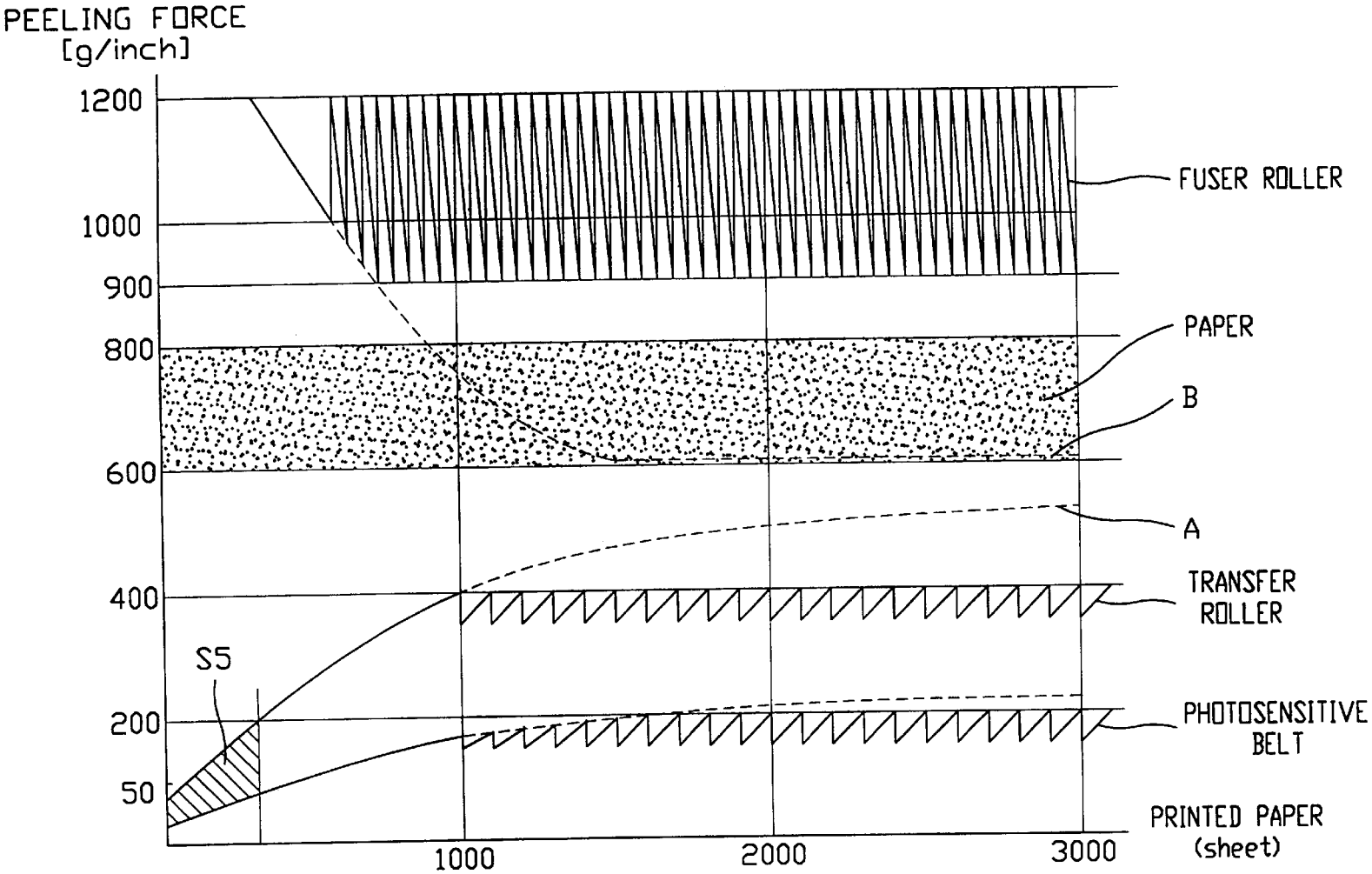
FIG. 4 is a graph illustrating the relationships of the peeling forces of a photosensitive belt, a transfer roller, and a fuser roller of the printing apparatus shown in FIG. 3 according to the number of printed sheets of paper.

Thereafter, when the peeling force of the transfer roller 141 becomes greater than 400 g/inch as indicated by the dotted line A of FIG. 4 as the number of printed sheets of paper surpasses 1000, bad transfer $T_2$ is caused. The peeling force adjusting device 160 restrains the peeling force from increasing as indicated by dotted line A. That is, when about 1000 sheets of paper are printed, the printing operation is stopped, and the toner remaining on the transfer roller 141 is removed by causing the friction member 161 to contact the transfer roller 141. In addition, while the toner remaining on the transfer roller 141 is removed, the friction member 161 is also caused to contact the photosensitive belt 110, and the peeling force of the photosensitive belt 110 is caused to decrease at the same time. Preferably, such a peeling force adjusting operation is performed at a predetermined intervals, for example, at every 100 printed sheets considering that the peeling force of the transfer roller increases in a predetermined pattern.

In addition, it is preferable that the peeling forces are lowered after a printing operation by cleaning the photosensitive belt 110 and the transfer roller 141 so that foreign materials such as the toner attached to the photosensitive belt 110 and the transfer roller 141 may not affect the subsequent printing operation.

Further, the cleaning belt 151 is caused to contact the surface of the fuser roller 143 continuously or intermittently to remove foreign materials such as the toner remaining on the fuser roller 143, and therefore the peeling force of the fuser roller 143 is restrained from decreasing as indicated by dotted line B of FIG. 4.

The toner remaining on the fuser roller 143 is removed by the cleaning belt 151 which is caused to contact the fuser roller 143 by the pressing member 155. At this time, a carrier is supplied to the contacting portion of the cleaning belt 151 and the fuser roller 143 so that the toner attached to the fuser roller 143 is easily moved to the cleaning belt 151.

In addition, the cleaning belt 151 is moved intermittently so that the cleaning performance thereof does not deteriorate due to the transferred toner. In an embodiment of the present invention, the take-up reel is rotated at every 100 printed sheets, and the cleaning belt 151 is moved about 2~4 mm from the supply reel to the take-up reel each time.

FIG. 4 shows a graph illustrating the variations of the peeling force of the fuser roller 143 when the cleaning belt 151 is caused to contact the fuser roller 143 at a period of 50 printed sheets. As a result of measuring the peeling force, the peeling force of the fuser roller 143 was about 1200 g/inch before the printing operation was performed, and the peeling force of the fuser roller 143 decreased to about 900 g/inch after about 50 sheets were printed. In a state in which the peeling force of the fuser roller 143 decreased as described above, the fuser roller 143 was contacted and cleaned by the cleaning belt 151, and then it was found that the peeling force of the fuser roller 143 increased to about 1200 g/inch. Therefore, since the peeling force of the fuser roller 143 can be controlled to always be greater than that of the paper sheet (P), the toner remaining on the transfer roller 141 can be moved easily to the fuser roller 143. In addition, since the toner remaining on the fuser roller 143 can be removed, contamination of the back side of the sheet of paper (P) can be prevented.

In addition, it is preferable that, in the liquid electrophotographic printing apparatus according to an embodiment of the present invention, the pressing force between the transfer roller 141 and the fuser roller 143 is 10 kgf greater than that between the photosensitive belt 110 and the transfer roller 141.

For example, referring to FIG. 3, when, in transfer $T_1$, the pressing force applied between the photosensitive belt 110 and the transfer roller 141 is F1, and in transfer $T_2$, the pressing force applied between the transfer roller 141 and the fuser roller 143 is F2, an image formed on the transfer roller 141 is transferred to the sheet of paper (P) in a condition in which F1 is 60 kgf, and F2 is 70 kgf. When the value of F2 is set to be 10 kgf greater than the value of F1, the peeling force of the sheet of paper (P) in transfer $T_2$ is greater than the peeling force of the transfer roller 141 in transfer $T_1$. Therefore, when the contacting condition between the transfer roller 141 and the fuser roller 143 (that is, the pressing condition of the sheet of paper (P) passing through between the transfer roller 141 and the fuser roller 143) is enhanced, the efficiency of image transfer to the sheet of paper (P) can be enhanced.

Though the pressing force F1 between the photosensitive belt 110 and the transfer roller 141 is exemplified in an embodiment of the present invention, it is understood that the set value is not an absolute value, and may be changed in the process of assembling the components, and also the value of F2 can be changed according to the change of the value of F1.

As described above, since, in the liquid electrophotographic printing apparatus according to the preferred embodiment of the present invention, the relationships of the peeling forces of the photosensitive belt, the transfer roller, and the fuser roller are set, and the peeling force adjusting device is provided for adjusting the peeling forces, the efficiency of image transfer from the photosensitive belt to the transfer roller, and the efficiency of image transfer from the transfer roller to the paper sheet can be enhanced. Therefore, occurrences of problems such as paper jams in which a sheet of paper wraps around the transfer roller, and contamination of the backside of a sheet of paper can reduced.

Although particular embodiments of the invention have been described with reference to the accompanying drawings for the purposes of illustration, it should be understood that various modifications and equivalents may be made by those skilled in the art without departing from the spirit and scope of the invention.

What is claimed is:

1. A liquid electrophotographic printing apparatus including:

a photosensitive belt circulating around a predetermined track, the photosensitive belt having a toner image thereon;

a transfer roller contacting the photosensitive belt, such that the toner image transfers from the photosensitive belt to the transfer roller;

a fuser roller pressing against the transfer roller with a pressing force, such that the toner image transferred to the transfer roller is transferred to a sheet passing between the transfer roller and the fuser roller;

a fuser roller cleaning device selectively contacting the fuser roller and maintaining a peeling force of the fuser roller within a predetermined range; and a peeling force adjusting device selectively contacting the transfer roller and maintaining a peeling force of the transfer roller within a predetermined range, wherein surface energies $SE_T$, $SE_P$, and $SE_F$ of the transfer roller, the sheet, and the fuser roller, respectively, satisfy the following inequality $$SE_T<SE_P<SE_F.$$

2. The liquid electrophotographic printing apparatus as claimed in claim 1, wherein when the peeling force $PF_P$ of the sheet is 600~800 g/inch, the peeling forces $PF_O$, $PF_T$, and $PF_F$ of the photosensitive belt, the transfer roller, and the fuser roller, respectively, satisfy the following inequalities in a printing mode $$5 \leqq PF_O \leqq 200 \text{ (g/inch)}$$

$$200 \leqq PF_T \leqq 500 \text{ (g/inch)}$$

$$900<PF_F<1200 \text{ (g/inch)}.$$

3. The liquid electrophotographic printing apparatus as claimed in claim 1, wherein the fuser roller is made from one of aluminum and an aluminum alloy.

4. The liquid electrophotographic printing apparatus as claimed in claim 1, wherein the fuser roller cleaning device comprises:

a supply reel and a take-up reel disposed adjacent to the fuser roller;

a cleaning belt transportable from the supply reel to the take-up reel, and selectively contacting the fuser roller to remove foreign materials from the outer circumferential surface of the fuser roller; and a pressing device selectively pressing the cleaning belt against the fuser roller.

5. The liquid electrophotographic printing apparatus as claimed in claim 4, wherein a liquid carrier is provided on the cleaning belt.

6. The liquid electrophotographic printing apparatus as claimed in claim 4, wherein the pressing device comprises:

a pressing member facing the fuser roller with the cleaning belt disposed therebetween;

an elastic member influencing the pressing member against the cleaning belt; and a cylinder selectively driving the pressing member in a direction away from the fuser roller against the influence of the elastic member.

7. The liquid electrophotographic printing apparatus as claimed in claim 1, wherein the peeling force adjusting device comprises:

a friction member disposed adjacent to the photosensitive belt and the transfer roller, and selectively contacting the photosensitive belt and the transfer roller simultaneously to remove foreign materials from the photosensitive belt and the transfer roller; and a pressing member for selectively moving the friction member between (1) a position in which the friction member contacts the photosensitive belt and the transfer roller and (2) a position in which the friction member is separated from the photosensitive belt and the transfer roller.

8. The liquid electrophotographic printing apparatus as claimed in claim 7, wherein the peeling force adjusting device further includes a nozzle for supplying a liquid carrier to the friction member.

9. The liquid electrophotographic printing apparatus as claimed in claim 1, wherein a pressing force between the transfer roller and the fuser roller is larger than a pressing force between the photosensitive belt and the transfer roller.

* * * * *